US011619032B2

(12) United States Patent
Thomas et al.

(10) Patent No.: US 11,619,032 B2
(45) Date of Patent: Apr. 4, 2023

(54) CONFIGURABLE MANIFOLD WATER DISTRIBUTION SYSTEM

(71) Applicant: Walmart Apollo, LLC, Bentonville, AR (US)

(72) Inventors: Michael John Thomas, Bentonville, AR (US); Alan Norton, Bentonville, AR (US); Gabriel Massa, Bentonville, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 219 days.

(21) Appl. No.: 17/008,522

(22) Filed: Aug. 31, 2020

(65) Prior Publication Data

US 2022/0064915 A1 Mar. 3, 2022

(51) Int. Cl.
*E03B 7/07* (2006.01)
*E03B 7/08* (2006.01)

(52) U.S. Cl.
CPC ..... *E03B 7/07* (2013.01); *E03B 7/074* (2013.01); *E03B 7/08* (2013.01)

(58) Field of Classification Search
CPC ... E03B 7/07; E03B 7/08; E03B 1/042; E03B 2001/045; C02F 1/003
See application file for complete search history.

(56) References Cited

U.S. PATENT DOCUMENTS 2,419,319 A * 4/1947 Lankton ..... E04B 1/34869 52/27
4,210,528 A * 7/1980 Coviello ..... C02F 3/1242 210/220
4,848,391 A 7/1989 Miller et al.
5,243,719 A * 9/1993 McDonald ..... E03B 1/04 4/415
5,971,303 A * 10/1999 Pugh-Gottlieb ..... E03B 1/044 241/101.2

(Continued)

FOREIGN PATENT DOCUMENTS

CN 107975105 A 5/2018
WO 2020168345 A1 8/2020

OTHER PUBLICATIONS

Unknown, "AcornVac Vacuum Plumbing Systems", AcornVac, date unknown, 36 pages.

*Primary Examiner* — Reinaldo Sanchez-Medina
(74) *Attorney, Agent, or Firm* — Barta, Jones & Foley, PLLC

(57) ABSTRACT

Examples provide a configurable, modular manifold system for distributing water. The manifold receives water via a first supply line dropped vertically down from a ceiling structure. The first supply line is connected to a water source, such as a water tank or pre-existing water line without demolition. The water may be heated or filtered and then supplied to a fixture or other device via a perpendicular second supply line. Drainage from the fixture is received via a drainage line. The drainage accumulates in an accumulator tank. The drainage water is pumped out via a second vertical drainage line carrying the drainage water away. The second line eventually connects to a pre-existing sewage line or septic system for treatment. The manifold may be moved or relocated easily to provide water to fixtures or other devices modularly without alteration of fixtures or access demolition to existing structures.

15 Claims, 16 Drawing Sheets

(56) References Cited

U.S. PATENT DOCUMENTS

| | | | | |
|---|---|---|---|---|
| 6,347,748 | B1 | 2/2002 | Lyons | |
| 6,814,861 | B2 | 11/2004 | Husain et al. | |
| 8,110,097 | B2 * | 2/2012 | Arai | E03D 5/016 210/194 |
| 9,586,685 | B2 | 3/2017 | Burd | |
| 2009/0020172 | A1 | 1/2009 | Walker | |
| 2011/0099918 | A1 * | 5/2011 | Buchmann | E04B 1/34869 52/79.1 |
| 2011/0226341 | A1 * | 9/2011 | Platteel | F28F 1/003 137/340 |
| 2012/0199220 | A1 * | 8/2012 | Knepp | E03B 1/041 137/558 |
| 2021/0010248 | A1 * | 1/2021 | Lyons | E03B 1/044 |

* cited by examiner

CONFIGURABLE MANIFOLD WATER DISTRIBUTION SYSTEM

BACKGROUND

Installing fixtures including running water, such as a sink, into a pre-existing building or other structure typically requires some type of demolition through floors and walls to reach water and sewage lines running under the foundation or buried beneath the structure. This type of addition can be time-consuming, disruptive to use of the building and cost prohibitive. In some cases, temporary, flexible water lines connecting to existing plumbing lines within a structure can be run through attic spaces or within interior walls to reach fixtures without permanent water hook-up while limiting the amount of demolition required for installation. However, these lines are less robust and more prone to maintenance issues, such as water leaks or other problems.

SUMMARY

Some examples provide a system for distributing water via a configurable manifold. An accumulator stores water within an interior of the accumulator. A set of vertical conduits connecting to a top member of the accumulator of the manifold, the set of vertical conduits comprising a first supply line and a first drainage line. A set of horizontal conduits connecting to a side member of the accumulator, the set of horizontal conduits comprising a second supply line and a second drainage line. A set of support members connecting at least a portion of the set of vertical conduits to a portion of a support frame. A set of pumps associated with the second drainage line, wherein the set of pumps provides water pressure to assist with moving drainage water out of the accumulator through the first drainage line associated with the set of vertical conduits.

Other examples provide a method for distributing water via a configurable manifold. Water is received from a first supply line associated with a set of vertical conduits connecting to the manifold. The set of vertical conduits comprising the first supply line and a first drainage line. The water is filtered by a set of filters. The filtered water is provided to at least one fixture via a second supply line associated with a set of horizontal conduits connecting to a side member of the manifold. The set of horizontal conduits comprising the second supply line and a second drainage line. The drainage water is received from the fixture via the second drainage line. The drainage water accumulates within an interior of an accumulator tank. The accumulated water moves out of the manifold via the first drainage line.

Still other examples provide a configurable manifold for distributing water. A first supply line providing water into the manifold. The first supply line connects to the accumulator. A set of filters removes impurities from the water. A second supply line provides the filtered water to a fixture. The second supply line connects to the accumulator. A first drainage line receives drainage water from the fixture. The accumulator stores accumulated drainage water received from the first drainage line. The drainage water moves out of the accumulator via a second drainage line. The second drainage line associated with a set of vertical conduits running vertically upwards toward a ceiling structure.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

Figure 1:
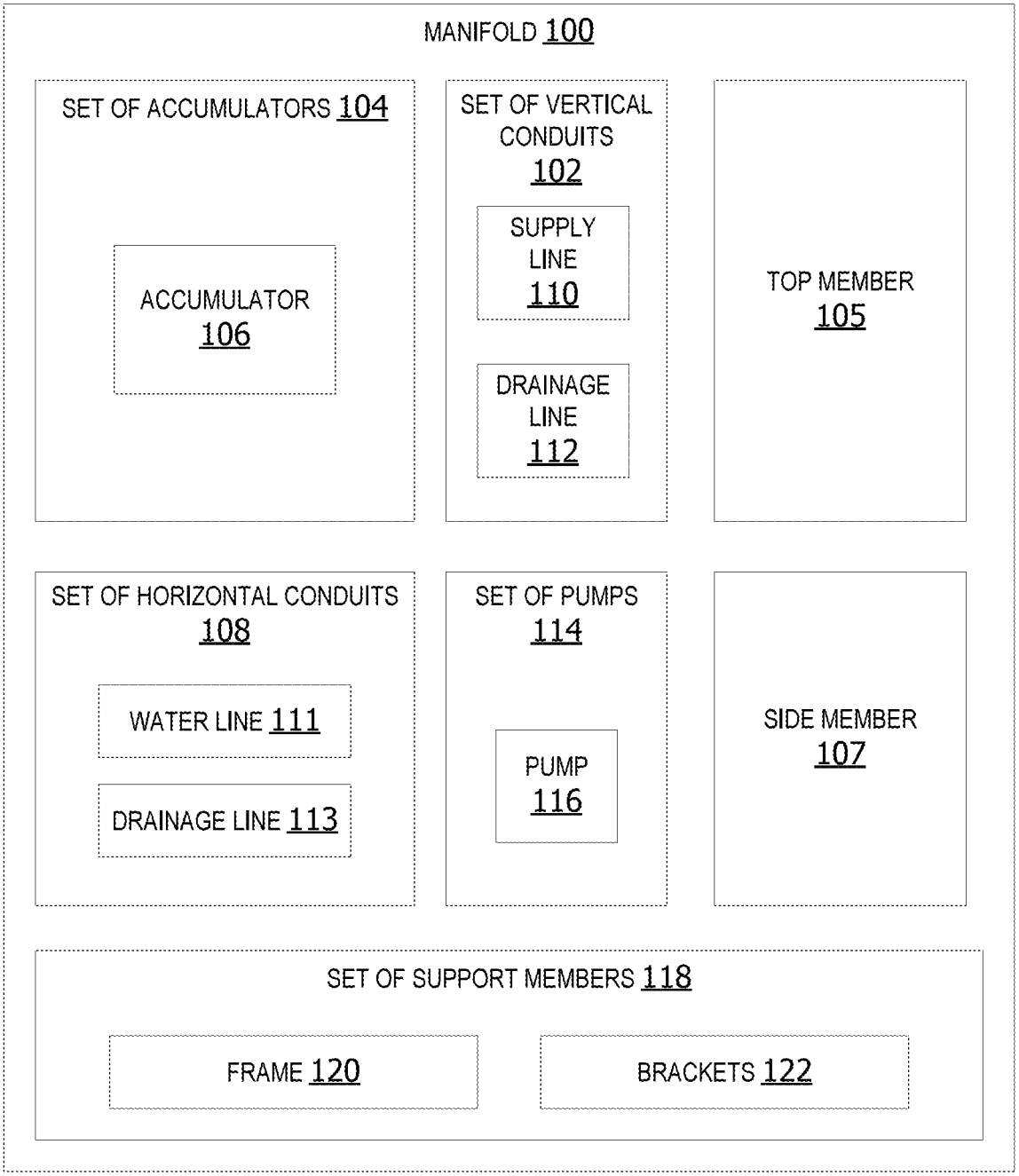
FIG. 1 is an exemplary block diagram illustrating a manifold for configurable water distribution.

A more detailed understanding can be obtained from the following description, presented by way of example, in conjunction with the accompanying drawings. The entities, connections, arrangements, and the like that are depicted in, and in connection with the various figures, are presented by way of example and not by way of limitation. As such, any and all statements or other indications as to what a particular figure depicts, what a particular element or entity in a particular figure is or has, and any and all similar statements, that can in isolation and out of context be read as absolute and therefore limiting, can only properly be read as being constructively preceded by a clause such as "In at least some examples, . . . " For brevity and clarity of presentation, this implied leading clause is not repeated ad nauseum.

Referring to the figures, examples of the disclosure enable a configurable manifold for supplying water to a fixtures or other tools and appliances utilizing water during their operation without immediate hookup to traditional underground sewer and water lines. The manifold in some examples is installed above ground to route water and other utilities to fixtures and other devices without expensive renovations or demolition to reach water and sewer lines for faster and more efficient provision of water and utilities to fixtures.

Aspects of the disclosure further enable a configurable and modular manifold for delivering clean water to a fixture and removing drainage water from the fixture without demolition or installation of underground water supply and drainage lines. The manifold enables quick and efficient provision of water sources within a modular space. The manifold system is easily moved or relocated to accommodate the pre-existing locations of doors, walls, floors, fixtures, devices, or other structures.

The manifold, in some examples, is a modular assembly sitting above a floor or foundation. The manifold is easily moved to accommodate reconfiguration of rooms, offices, furnishing, fixtures, or other structures as desired by users without expensive demolition or remodeling of pre-existing buildings. Provision of water and other utilities via the manifold without demolition further eliminates hazards associated with renovations, such as, but not limited to, exposure to harmful silica dust.

Referring again to FIG. 1, an exemplary block diagram illustrates a manifold 100 for configurable water distribution without hookup to underground sewer drainage or water supply lines. The manifold 100 in some examples includes a set of one or more accumulators 104. An accumulator 106 in the set of accumulators is a tank or container for storing or holding water received from a water supply line running into the manifold 100 via a set of one or more vertical conduits 102.

In this example, only a single accumulator is shown. However, the examples are not limited to a single accumulator. In other examples, the manifold can include two or more accumulator tanks. In these examples, each accumulator tank is connected to a different drain or other source of wastewater flowing into the manifold from one or more fixtures, water-utilizing tools or other sources. Each accumulator accumulates the wastewater until the wastewater can be evacuated out of the accumulator tank(s) via a drainage pipe or conduit.

The set of vertical conduits 102 is a set of one or more pipes, channels, or tubes for providing a conduit for water, water lines, gas, gas lines, electrical wires, network cable, fiber optic cables or any other supply lines. In some non-limiting examples, the set of vertical conduits 102 run vertically up from a top of the accumulator 106 and into the ceiling of a room and down from the ceiling back into the top of the accumulator.

A set of horizontal conduits 108 includes one or more tubes, pipes, channels, or other conduits for supplying water, gas, air, electrical, network connection or other resource. In some examples, the set of horizontal conduits 108 connect to a side member 107 of the accumulator 106 via one or more connectors, such as, but not limited to, the horizontal line connectors 610 in FIG. 6 below.

The water accumulating in the accumulator 106, in some examples, is clean water which enters the accumulator via a first supply line 110 in the set of vertical conduits 102. In some examples, the set of vertical conduits 102 attach to a set of connectors associated with a top member 105 of the accumulator 106.

The water exits the accumulator via a second supply line 111 in the set of one or more horizontal conduits 108. The water flows out of the accumulator 106 and into a fixture, appliance or other water utilizing tool.

In other non-limiting examples, the water in the accumulator 106 is dirty or used water entering the accumulator via a drainage line 112 from a sink or other drain associated with some other type of fixture via the set of horizontal conduits 108.

A set of one or more pumps 114 provides air suction, pressure, or vacuum, such as is utilized with dental or medical tools. In some examples, a pump 116 in the set of pumps 114 includes a vacuum pump generating suction or vacuum for utilization with dental tools, such as a suction aspirator wand. The pump assist with pumping water out of the accumulator via a second drainage line 113 associated with the set of vertical conduits.

In other examples, the set of pumps 114 includes pumps generating suction or pressure to assist with moving water up through water lines associated with the set of vertical conduits 102 and/or through the set of horizontal conduits 108. In these examples, the pump 116 may include a utility pump, in-line pump, centrifugal pump, positive displacement water pump or any other type of water pump. In still other examples, a pump is unnecessary to move water through the water lines, as water pressure within the lines provides the necessary pressure to move the water.

A set of one or more support members 118 are optionally included to stabilize or otherwise support one or more members of the manifold. In some examples, the set of support members 118 includes a frame 120 for supporting the set of vertical conduits 102 and/or the set of horizontal conduits 108. The frame 120 may be a frame composed of metal, plastic, a composite, or any other material.

The set of support members 118, in still other examples, includes a set of brackets for attaching one or more members of the manifold to the frame 120, such as, but not limited to, a water line, drainage line, compressed air line or conduits.

Figure 2:
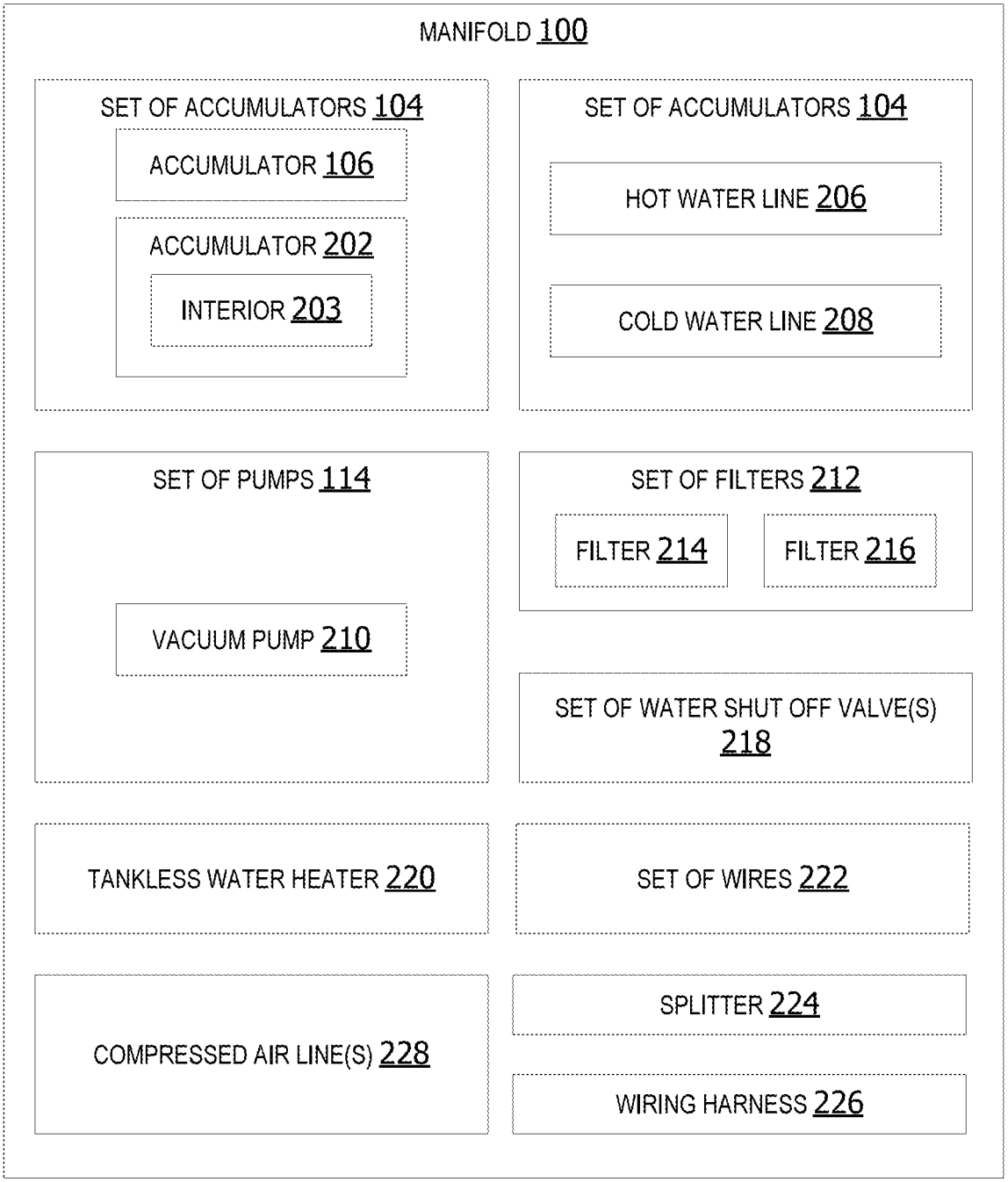
FIG. 2 is an exemplary block diagram illustrating a configurable manifold for water distribution including a set of accumulators.

FIG. 2 is an exemplary block diagram illustrating a configurable manifold 100 for water distribution including a set of accumulators 104. The set of accumulators include one or more accumulator tanks. In this example, the set of accumulators includes two tanks, accumulator 106 and accumulator 202. However, the examples are not limited to two accumulator tanks. In other examples, the manifold includes a single accumulator tank. In other examples, the manifold includes three or more accumulators.

Each accumulator accumulates water from a supply line providing clean water from a clean water source or drainage water from a drainage water line receiving water from a fixture drain. In this example, the accumulator 106 receives drainage water from a first fixture, such as a sink. The accumulator 202 receives drainage water from a second fixture, such as a dental irrigator tool, water fountain, shower, or other fixture. However, the examples are not limited to the accumulator receiving drainage water from a drainage line.

In other examples, the accumulator 106 receives water from a hot water line 206 in a set of one or more water lines 204 providing incoming clean water. The accumulator 202 receives cold water from a cold-water line 208. However, the examples are not limited to accumulators receiving hot and cold water from water supply lines. In still other examples, the accumulator 106 receives clean water from a clean water supply line and the accumulator 202 accumulates drainage water from a drainage water line. The accumulator stores accumulated water within an interior 203 of the accumulator.

A set of pumps 114 provides one or more pumps. The set of pumps can include pumps for moving water through the set of water lines 204. The set of pumps in other examples can include pumps for creating a vacuum, such as a vacuum pump 210. The vacuum pump 210 may be utilized in association with dental or medical tools, such as, but not limited to, a suction aspirator tool. In such examples, a vacuum line associated with the vacuum pump 210 runs through the set of vertical conduits to connect to the suction aspirator or other tool. The vacuum pump 210 creates the vacuum provided by the tool during utilization in medical or dental procedures.

The manifold 100 optionally includes a set of one or more filters 212 associated with a water filtering system for removing impurities or particulates from water entering the manifold 100 via one or more water supply lines. In this example, the set of filters 212 includes two filters, filter 214 and filter 216. However, the examples are not limited to utilization with two filters. In other examples, the set of filters 212 can include a single filter, as well as three or more filters. A filter in the set of filters may include a carbon filter, media filter, screen filter, sand filter, cloth filter, disk filter, biological filter, or any other type of filter.

A set of one or more shut off valve(s) 218 are optionally included. A shut off valve in the set of shut off valves may include a general water shut off valve to shut off all water flowing into the manifold, a shut off valve to stop water flowing out of the manifold, a shut off valve to shut off hot water line 206, a shut off valve to shut off water from the cold water line 208, a shut off valve to bypass the water filtering system associated with the set of filters 212, or any other type of water shut off valve.

In other examples, the manifold includes a tankless water heater 220. The tankless water heater 220 heats water flowing into the manifold. The water flowing out of the tankless water heater 220 is diverted into a hot water line exiting the manifold and flowing into a hot water line on a fixture, such as a sink, shower, bathtub, water dispenser, or other fixture.

The manifold 100 in other examples includes a set of wires 222 running vertically down from the ceiling of a structure via the horizontal conduits, such as, but not limited to, wires in a wiring harness 226. The set of wires 222 may include electrical wires, network wires, telephone wires, or any other type of wires or cabling. The wires 222 may be associated with a splitter 224 which diverts the wire(s) to various devices or appliances upon exiting the manifold.

In still other examples, the manifold may include one or more compressed air line(s) 228 running vertically down from the ceiling into the manifold via the set of vertical conduits. The compressed air line(s) exit from a side portion of the manifold running to one or more air tools or devices utilizing the compressed air during operation.

Figure 3:
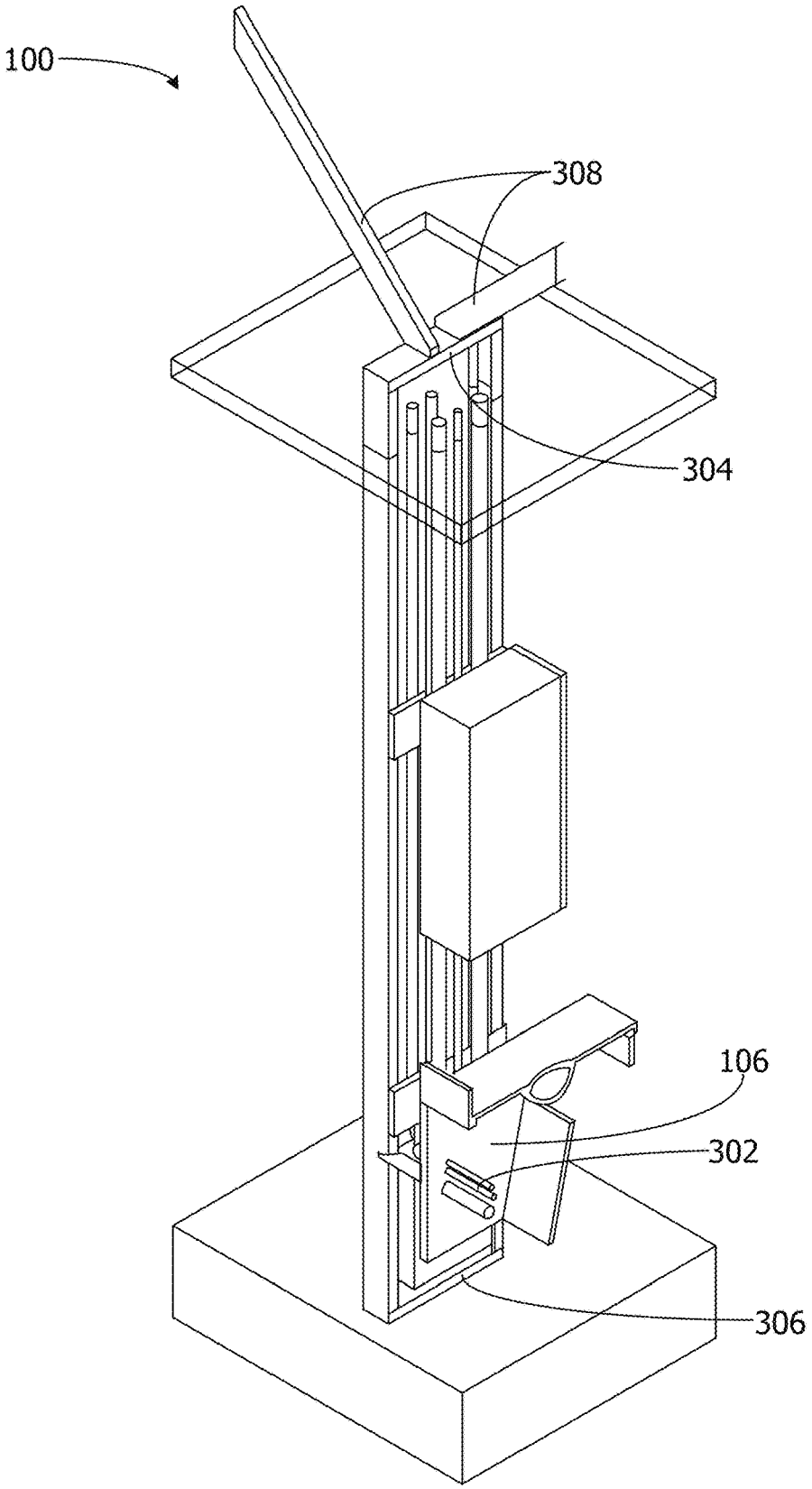
FIG. 3 is an exemplary block diagram illustrating a manifold including supply and drainage lines extending vertically to a ceiling structure.

FIG. 3 is an exemplary block diagram illustrating a manifold 100 including supply and drainage lines extending vertically to a ceiling structure. In this non-limiting example, the manifold includes supply and drainage lines 302 running vertically up and down from a ceiling structure above to the accumulator 106. The supply and drainage lines 302 include supply lines carrying incoming clean water from a water source and outgoing drainage lines carrying water from at least one drain out.

In some examples, the accumulator is supported within a frame structure, such as, but not limited to, the frame 120 in FIG. 1. In this non-limiting example, the frame includes a top track 304 and a bottom track 306 associated with a base of the accumulator. In this example, the top track 304 removably attaches to a portion of a top member of a panel and the bottom track 306 attaches to a bottom portion of the panel. The frame optionally also includes a bracing 308 which extends to a ceiling structure above to provide additional support.

Figure 4:
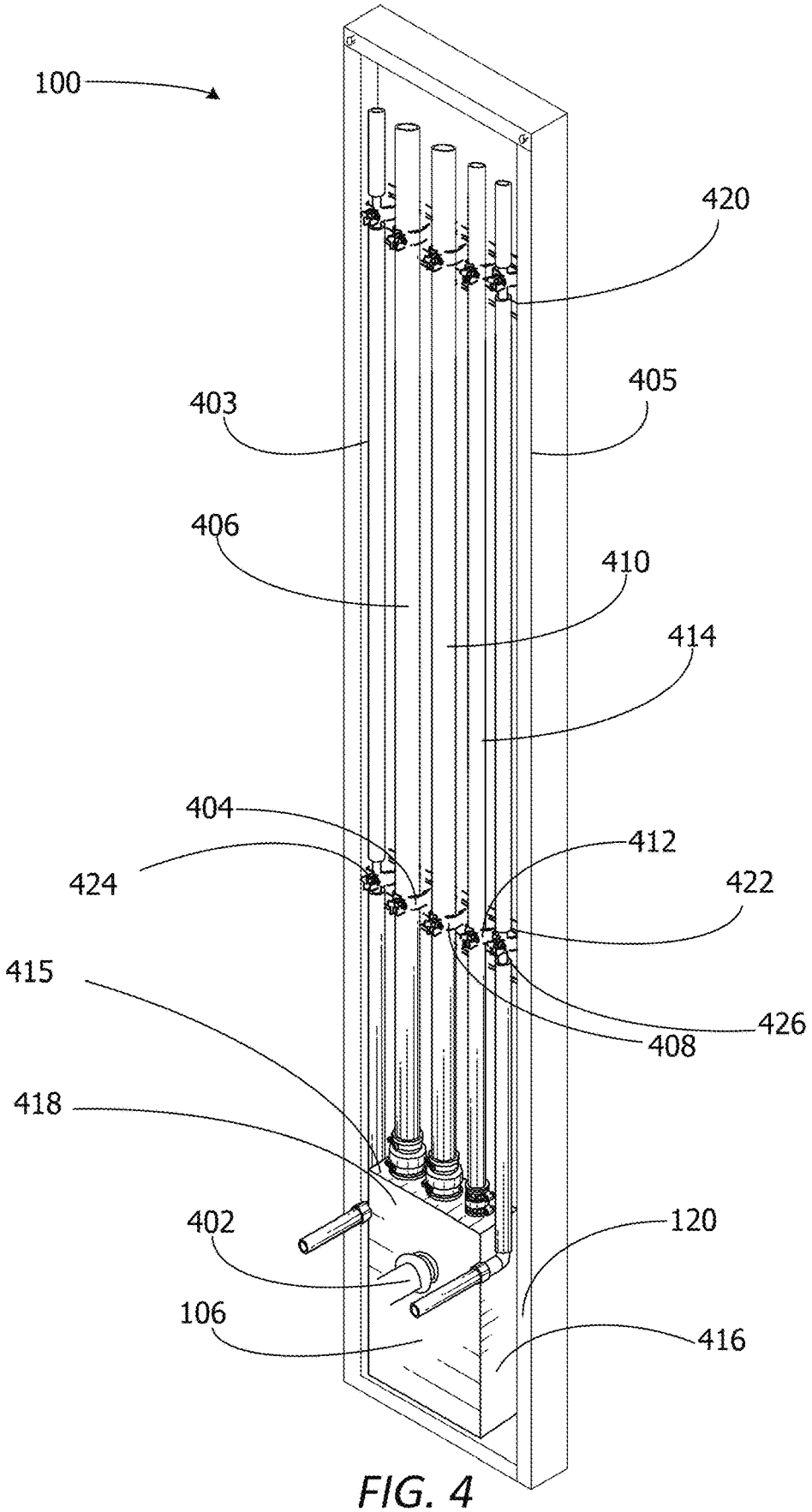
FIG. 4 is an exemplary block diagram illustrating a manifold including a horizontal conduit extending laterally from an accumulator.

Turning now to FIG. 4, an exemplary block diagram illustrating a manifold 100 including a horizontal conduit 402 extending laterally from an accumulator 106 is shown. The horizontal conduit 402 is a channel, tube, pipe, or other type of conduit for moving water, air, or other substances from the manifold to a fixture or other device or from the fixture or other device back into the manifold. In some non-limiting examples, the horizontal conduit encloses one or more water pipes or tubes for moving drainage water and/or clean water supply.

The manifold includes a set of vertical pipes or conduits for moving water, air, wires, or other substances vertically down from the ceiling towards the accumulator. The set of vertical conduits can include a set of brackets for supporting each of the conduits. In this example, a bracket 404 secures a conduit 406 to a portion of the support frame 120. A bracket 408 secures the conduit 410 to a portion of the support frame. A bracket 412 attaches the conduit 414 to a portion of the support frame 120.

The set of brackets securing the incoming water supply lines and conduits to the horizontal support frame 422 of the support frame in this example includes bracket 404, 408, 412, 424 and 426. However, the examples are not limited to 5 brackets. In other examples, the set of brackets can include a single bracket, two brackets, three brackets, four brackets, as well as six or more brackets securing any number of conduits, air lines, water lines and/or drainage lines to the support frame. The conduits may include electrical wiring bundles, fiber optic cabling, network cabling, air, water or any other resource within the conduit.

The horizontal support frame 420 may also include a set of one or more brackets securing one or more water lines, wiring harness/wiring bundle, pipe, or other conduit to the horizontal support frame. In this example, the set of brackets includes five brackets. In other examples, the set of brackets may include one or more brackets. Likewise, in still other examples, the frame may not include a horizontal support member or any brackets. In such cases, the manifold is secured directly to the support frame 120.

In some examples, the set of vertical conduits includes a hot water pipe 403 bringing hot water down towards the accumulator. The hot water pipe 403 in this example is a copper water line. The hot water pipe 403 may be wrapped in insulation. In other examples, the pipe is partially enclosed within or runs through a polyvinyl chloride (PVC) pipe. The hot water pipe 403 in a non-limiting example is a half inch diameter pipe. In this example, the hot water pipe 403 does not connect to the accumulator, but rather it bends vertically near the point where it reaches or contacts the accumulator. The hot water pipe ends in a connection enabling the pipe to be connected to a fixture.

The set of vertical conduits in other examples includes a cold-water pipe 405 bringing clean cold water down towards the top of the accumulator. In some examples, the cold-water pipe 405 is a copper water line. The cold-water pipe 405 may be wrapped in insulation. In other examples, the pipe may be enclosed within a PVC pipe or other conduit. The cold-water pipe 405 in this non-limiting example is a half inch diameter pipe. In some examples, the cold-water pipe 405 does not connect to the accumulator, but rather it bends vertically near the point where it reaches or contacts the accumulator. The hot water pipe ends in a connection enabling the pipe to be connected to a fixture.

In other non-limiting examples, the conduit 406 is a one-and-a-half-inch diameter pipe or conduit enclosing one or more sensors. The sensor(s) provide diagnostic data and status data associated with function and/or operation of the manifold. In these examples, the conduit 406 connects to the accumulator via a connector. The sensor(s) gather data, such as, but not limited to, sensor data associated with the quantity of water within the accumulator, water flow rate into the accumulator, water pumped out of the accumulator, etc.

The conduit 410 in still other examples may be implemented as a one-and-a-half-inch conduit for moving air. This air inlet enables movement of air into the accumulator and/or out of the accumulator. The air inlet in some examples provides vacuum for suction or pumping wastewater out of the accumulator.

In still other non-limiting examples, the conduit 414 moves wastewater out of the accumulator via a pump, vacuum, suction, air pressure or other method for pulling or pushing wastewater out of the accumulator and vertically upward through the wastewater conduit. In a non-limiting example, the conduit 414 is a three-fourths inch diameter pipe for moving wastewater which has accumulated within the accumulator out of the manifold.

The conduits 406, 410 and 414 connect to a member of the accumulator via one or more connectors at one end of each conduit. The opposite end of each conduit connects to another pipe, conduit, pump, air supply, or other device above a ceiling, ceiling tiles or other support structure located a predetermined distance above the manifold.

In this example, the conduits 406, 410 and 414 connect to a top member 415 of the accumulator. However, in other examples, one or more of the conduits can connect to the accumulator tank via a connector at a side member of the accumulator, such as, but not limited to, the side member 416, the front member 418, or any other portion of the accumulator.

In some examples, the set of vertical conduits are supported and stabilized by a set of horizontal support members of the support frame 120. In some examples, the support frame 120 includes a first horizontal support member 420 supporting the set of vertical conduits at a first location and a second horizontal support member 422 supporting the set of vertical conduits at a second location along the support frame.

In this example, a first set of clamps secures the set of conduits including conduit 406, 410 and 414 at the first horizontal support member 420. A second set of clamps secures the set of conduits to the second horizontal support member 422. However, the examples are not limited to two horizontal support members. In other examples, the support frame does not include any horizontal supports. In still other examples, the conduits are secured to a single horizontal support member. In yet other examples, the support frame 120 can include three or more horizontal support frames.

Figure 5:
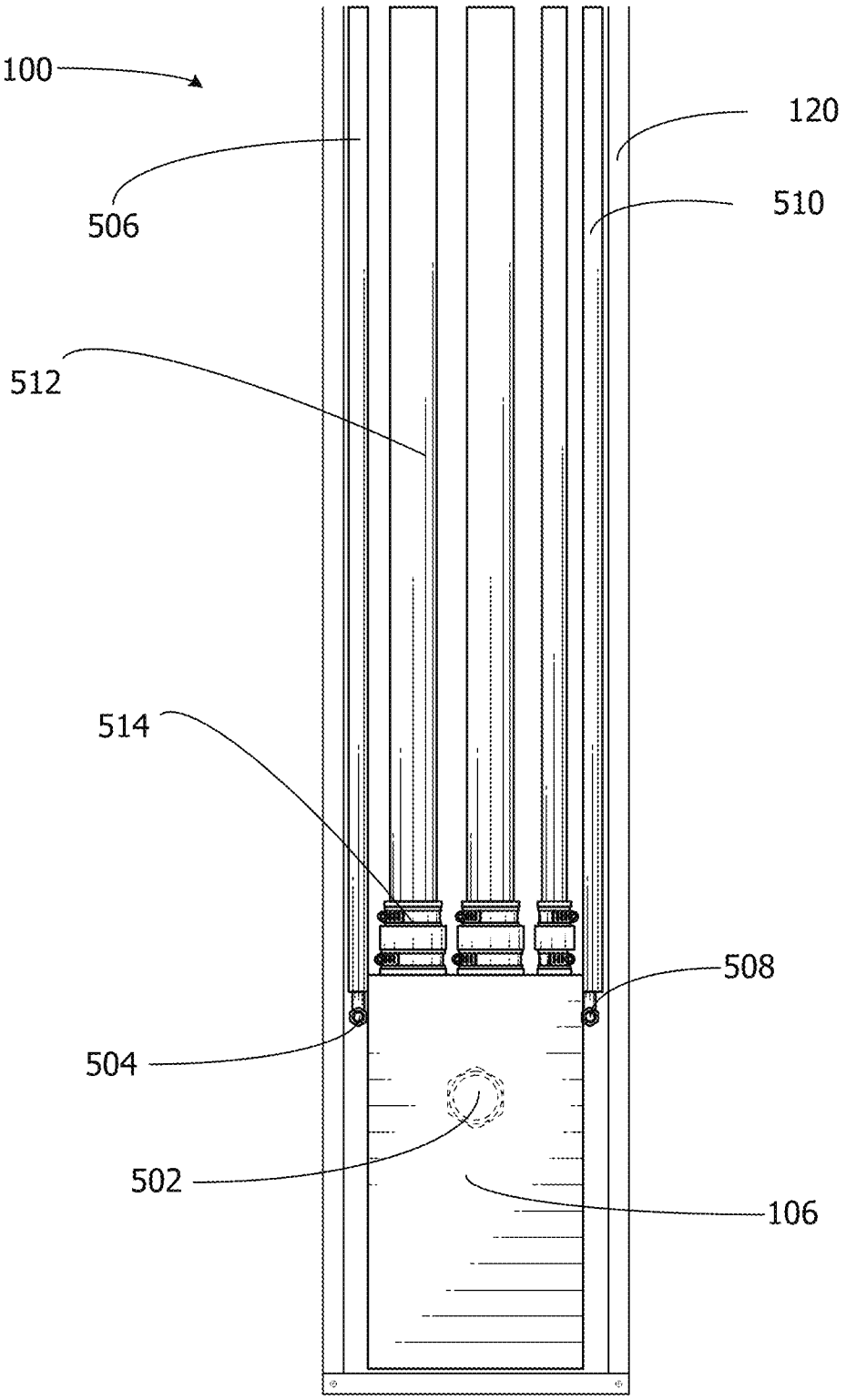
FIG. 5 is an exemplary block diagram illustrating a manifold including a horizontal connection for connecting the accumulator to supply and drainage lines for a fixture.

Turning now to FIG. 5, an exemplary block diagram illustrating a manifold 100 including a horizontal connection 502 for connecting the accumulator 106 to one or more wastewater drainage lines coming from one or more fixtures is shown. The horizontal connection 502 connects to one or more conduits and/or water drainage lines running from the one or more fixtures.

In some examples, the vertical conduits include a set of water lines. In this example, the water lines include a first water supply line 504 and/or a second water supply line 508. In this example, a portion of the water supply line 504 is covered with insulation 506 to create an insulated water line. Likewise, a portion of the water supply line 508 is covered with insulation 510. The insulation assist with maintaining the temperature of cold and hot water supply lines.

In one example, the water supply line 504 is a cold-water line bringing clean cold water from a water source to a fixture via the set of vertical conduits. The water supply line 508 in other examples is a hot water line bringing clean hot water from a hot water source to a fixture. However, the examples are not limited to this configuration. In other examples, the water supply line 504 can be a hot water line and the water supply line 508 can be the cold-water line.

The water supply lines 504 and/or 508 may be implemented as copper water lines. In other examples, the water supply lines 504 and/or 506 may be implemented as plastic water lines, metal pipes, rubber water lines, PVC lines or any other type of pipes, tubes, or hoses for running clean water.

In still other examples, there may be only a single water line bringing clean, cold or room temperature water to the manifold. The manifold can include a tankless water heater which heats the water before sending the heated water into the hot water line. The unheated water flows through the cold-water line.

In other examples, a set of brackets (not shown) secure at least a portion of the vertical conduits to at least a portion of the support frame. The support frame 120 stabilizes the conduits and prevents the conduits from detaching from connection points on the accumulator 106. In this example, the accumulator and the set of vertical conduits and/or water lines are supported within the support frame 120 without any horizontal support members. However, the support frame is not limited to no horizontal support members. In other examples, the frame can include a single horizontal support member, as well as two or more horizontal support members.

In some examples, the hot water line and/or cold-water line do not connect directly into the accumulator. Instead, the hot water line and cold-water lines run parallel vertically downward with the set of vertical conduits. When the hot and cold-water lines reach the accumulator, the lines bend horizontally (parallel with the floor). The hot and cold-water lines include connectors enabling the lines to be connected to a faucet, spout, water fountain or other water supply fixture. In this example, the water supply (incoming clean water) lines 504 and 508 do not connect directly into the accumulator.

The vertical set of conduits in other examples includes one or more conduits, such as, but not limited to, the conduit 512. Each conduit connects to a portion of the accumulator via a connector. The connector creates an airtight seal and/or watertight seal in some examples. The connector may be implemented as, for example but without limitation, a bracket, clamp, adapter, or any other type of connector.

In this example, the conduit 512 connects to the accumulator via the connector 514. If the conduit 512 is a wastewater pipe, the wastewater flows out of the accumulator through a hole, portal, or other opening into the conduit 512. The wastewater flows up the conduit 512 and out of the manifold. The wastewater pipe eventually carries the wastewater to a destination or connects to one or more other pipes which carries the wastewater to the destination. The destination for wastewater is, in some examples, but without limitation, a buried wastewater sewage pipe, a septic tank, a storage tank, water truck, wastewater processing facility, etc.

Figure 6:
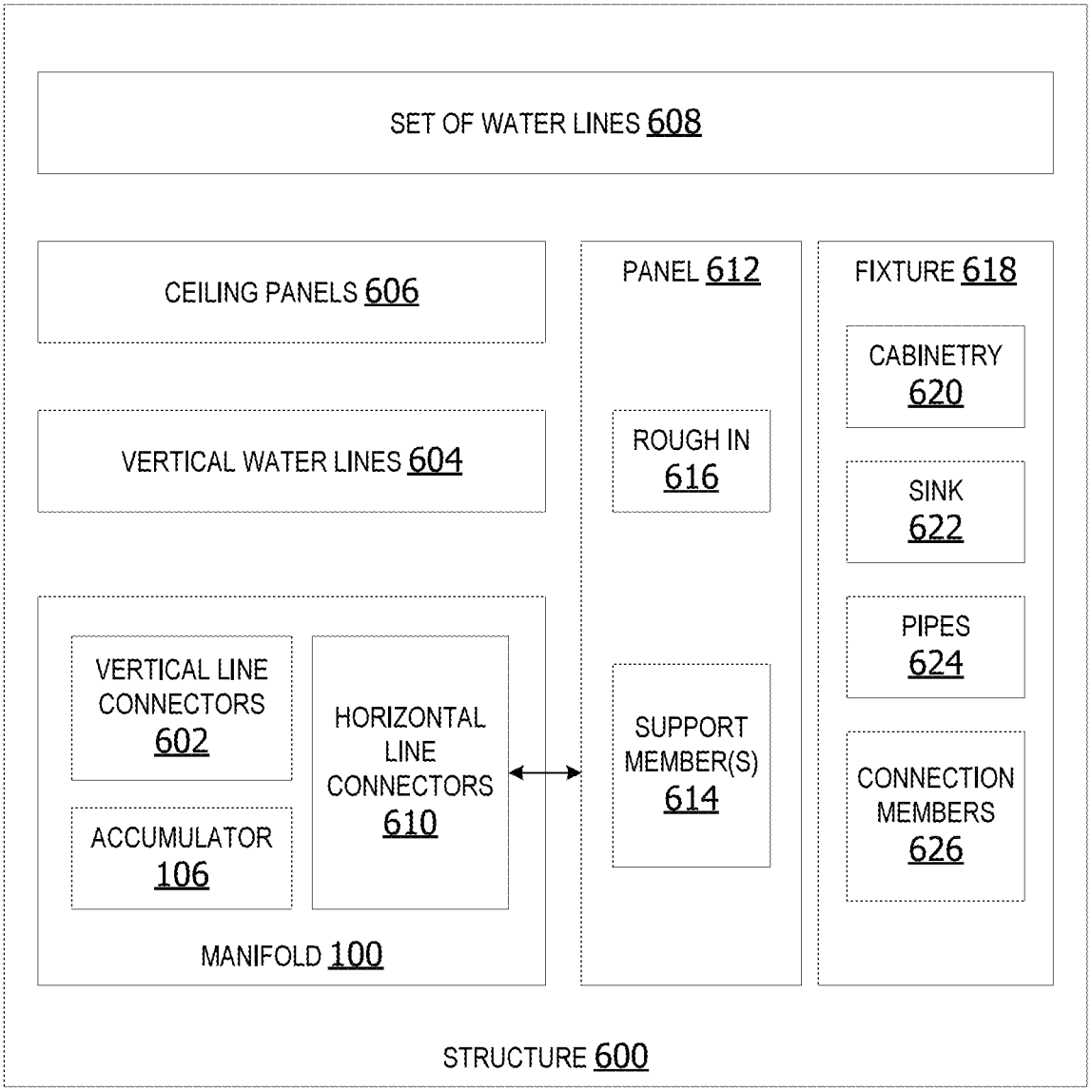
FIG. 6 is an exemplary block diagram illustrating a set of panels associated with a manifold within a structure.

FIG. 6 is an exemplary block diagram illustrating a set of panels associated with a manifold 100 within a structure 600. In some examples, a set of vertical line connectors 602 on the manifold 100 connect a set of one or more vertical water lines 604 to a top portion of the accumulator 106. The vertical water lines 604 in some examples are implemented as one or more conduits, such as, but not limited to, the set of vertical conduits 102 in FIG. 1. In other examples, the vertical water lines 604 run within the conduits.

The vertical water lines 604 run vertically down from one or more ceiling panels, in some non-limiting examples. The vertical water lines 604 connect to a set of one or more water lines 608 running above the ceiling structure and/or ceiling panels 606. In other examples, the vertical water lines 604 become the set of water lines 608 after the vertical water lines 604 exit through an aperture in the ceiling panels and cross above the ceiling structure.

One or more horizontal line connectors 610 on a side member of the accumulator 106 are utilized to connect the accumulator to a set of horizontal water lines with a fixture 618, such as, but not limited to, the set of horizontal conduits 108 in FIG. 1. The horizontal water lines in this example pass through a portal or rough in 616 within a panel 612 abutting the manifold. The panel 612 serves as one or more support member(s) 614 for the manifold and assists in hiding the manifold from view for a more aesthetically pleasing appearance. The rough in is a hole, portal or opening within the panel 612 having a diameter sufficient to accommodate the water supply line and the drainage line.

In some examples, the rough in 616 diameter is also sufficient to accommodate any other wire bundles, cables, gas lines, compressed air lines, vacuum lines or other resource lines running from the manifold to the fixture. However, in other examples, electrical wires, air lines, gas lines, cable, or other non-water lines exit the manifold via a splitter rather than via the horizontal line connectors and/or rough in 616.

The fixture 618 in this non-limiting example is a sink 622 fitted within cabinetry 620. A set of one or more pipes 624 connect to the horizontal water supply and drainage lines running to and from the accumulator. The horizontal water supply and drainage lines connect to the pipes 624 via one or more connection members 626. The connection members 626 can include, for example but without limitation, pipe joints, fittings, and/or other connectors.

Figure 7:
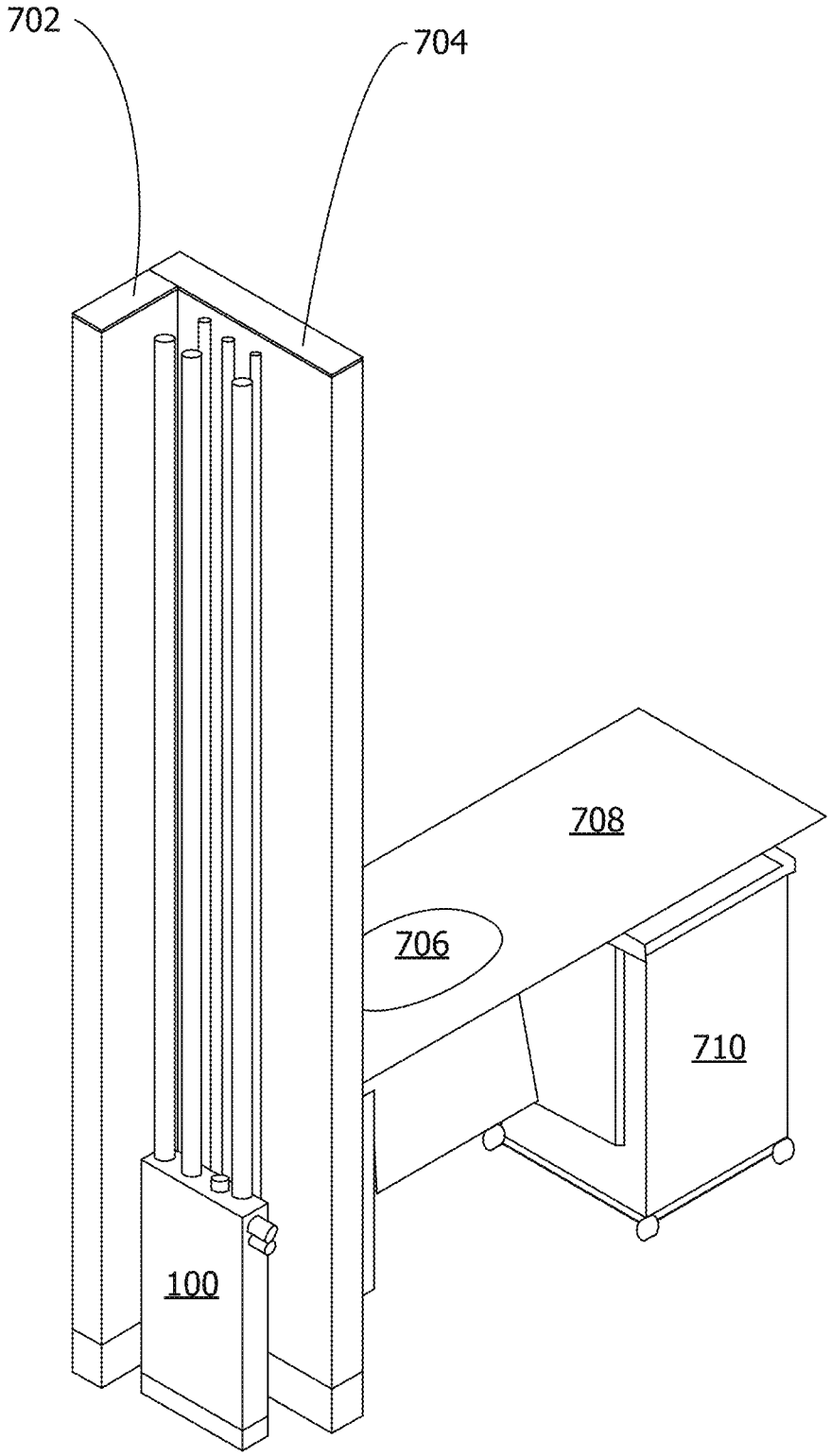
FIG. 7 is an exemplary block diagram illustrating a manifold connected to a fixture.

FIG. 7 is an exemplary block diagram illustrating a manifold 100 connected to a fixture. In this non-limiting examples, a first panel 702 is placed on a first side of the manifold and a second panel 704 is placed on a second side of the manifold 100 to hide the manifold from the field of view of users within the structure. Water lines running vertically downward carry water supply into the manifold. Horizontal water lines running horizontally out of the side of the accumulator carry the water supply to the fixture.

In some examples, drainage from the fixture is returned to the accumulator via the horizontal water lines entering back into the side of the accumulator. The drainage water in this example accumulates within the accumulator. A pump pumps the drainage water out of the accumulator and up through the vertical water lines into the set of water lines running above the ceiling structure. These water lines running above the ceiling structure carry the drainage water to a sewage line connection point or a storage, such as, but not limited to, a water truck, a septic tank, or other appropriate sewage treatment area.

In this example, the fixture is a sink 706. However, the manifold is not limited to utilization with a sink. The fixture in other examples can include medical or dental tools, water fountains, appliances, etc.

In this example, the fixture is a sink 706, including a bowl fitted within a countertop 708 and cabinetry 710. However, the examples are not limited to utilization of the manifold with a sink having a countertop and cabinetry. The manifold may be utilized with any type of water-based fixture for supplying clean water and removing dirty/used water. In other examples, the fixture may include a bowl type sink that sits on top of a counter or other surface, without any cabinetry. In still other examples, the fixture may include a sink without any countertop or cabinetry, such that the plumbing pipes are visible or only partially hidden by a curtain, screen, or paneling.

Figure 8:
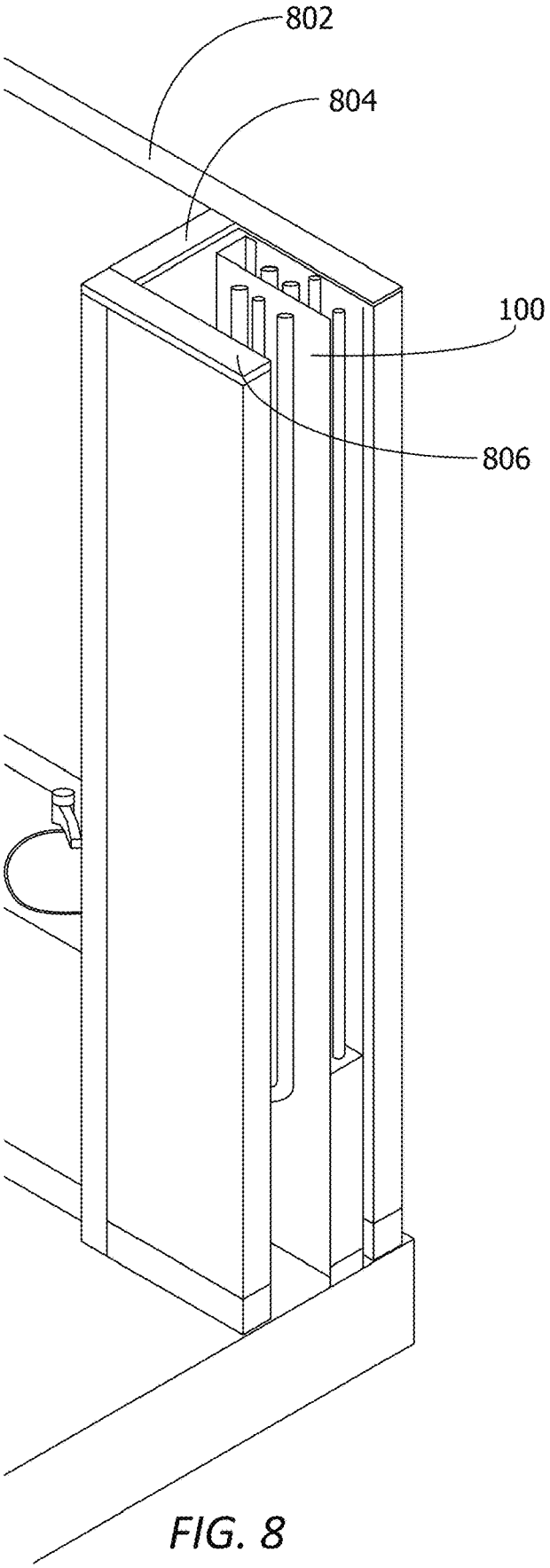
FIG. 8 is an exemplary block diagram illustrating a manifold at least partially enclosed by a set of panels.

FIG. 8 is an exemplary block diagram illustrating a manifold 100 at least partially enclosed by a set of panels. In this non-limiting example, the set of panels includes a first panel 802 forming a wall, a second panel 804 associated with a first side of the manifold and a third panel 806 associated with a second side of the manifold.

In this example, the panels 802, 804 and 806 are rigid panels. However, the examples are not limited to rigid panels. In other examples, the panels may be implemented as cloth curtains, cloth panels, sliding panels, folding accordion style panels, screens, shade, or any other type of material or article for obstructing or partially obstructing view of any portion of the manifold. In still other examples, the manifold may be hidden behind a temporary or permanent wall. In yet other examples, the manifold may be left uncovered without any paneling to hide it, such that the manifold is open to view.

Figure 9:
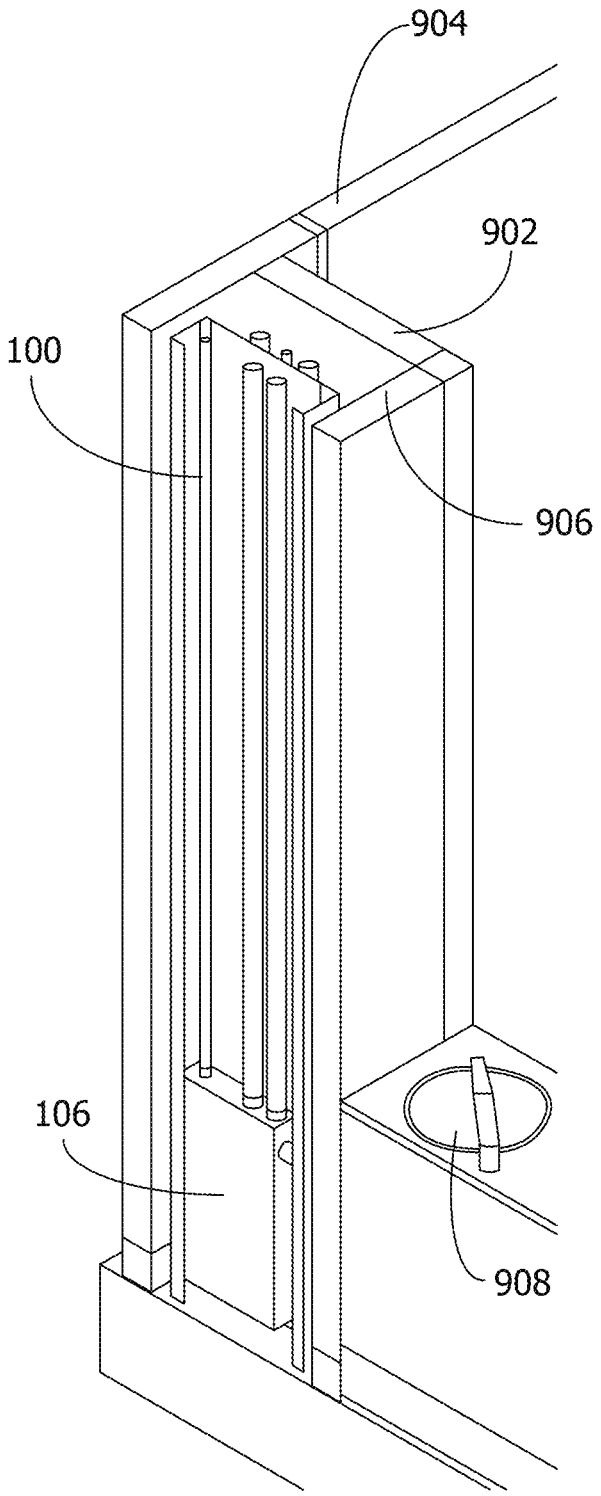
FIG. 9 is an exemplary block diagram illustrating a manifold enclosed by a set of panels connected to a sink.

Referring now to FIG. 9, an exemplary block diagram illustrating a manifold 100 enclosed by a set of panels connected to a sink 908 is shown. The manifold is at least partially hidden from the field of view of human users within the structure by a set of panels. In this example, the set of panels includes a first panel 902, a second panel 904 and a third panel 906. However, the examples are not limited to a set of three panels. In other examples, the set of panels includes a single panel, two panels, as well as four or more panels.

A panel in the set of panels can include a horizontal panel which is interchangeable with one or more other panels. Each panel can be interlocked or interconnected with one or more other panels. One or more of the panels may include an opening or rough in to permit water conduits, cords, wires, cables, or other lines to pass through the panel from the manifold. A panel may be made of metal, cloth, plastic, a composite material, or any other suitable substance.

In some examples, each panel in the set of panels reaches from the floor to the ceiling. In other examples, the panel may not reach all the way up to the ceiling panels.

Figure 10:
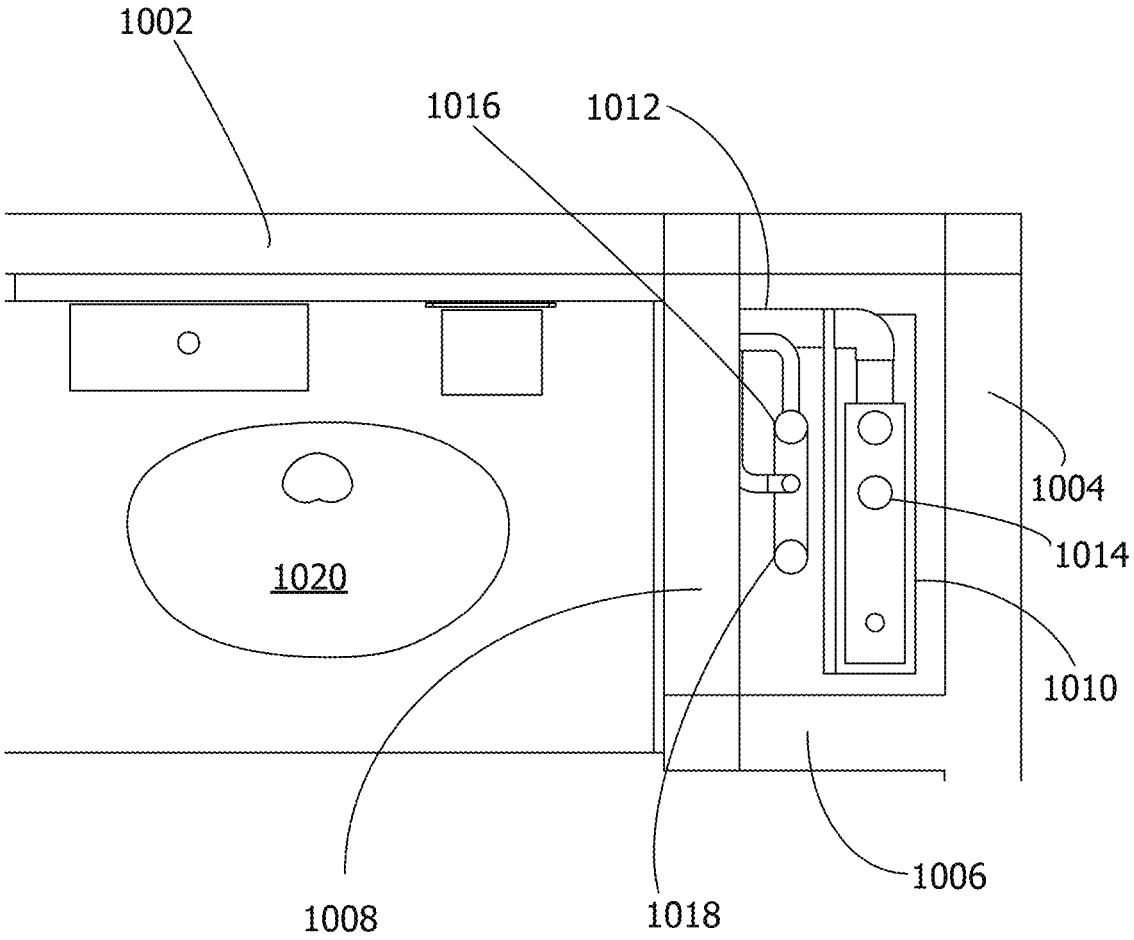
FIG. 10 is an exemplary block diagram illustrating a top view of a manifold at least partially enclosed by a set of panels.

FIG. 10 is an exemplary block diagram illustrating a top view of a manifold 100 at least partially enclosed by a set of panels. The set of panels in this example includes a panel 1002, a panel 1004, a panel 1006 and a panel 1008. However, the examples are not limited to enclosing the manifold within four panels. In other examples, the manifold may not be enclosed within any panels or the manifold may only be associated with a single panel, two panels or three panels to partially hide the manifold from the view of users standing within visual range of the manifold.

Wastewater flows out of the sink or other fixture and into the accumulator 1010 via a wastewater pipe 1012. The wastewater pipe runs from a drain or other wastewater outlet into the accumulator 1010 storage tank. The wastewater flows out of the accumulator 1010 through one or more vertical pipe(s), such as, but not limited to, the conduit 1014.

Clean water flows through one or more pipes in the set of vertical conduits, such as, but not limited to, the pipes 1016 and 1018. The clean water pipes 1016 and 1018 do not connect directly to the accumulator. Instead, the clean water pipes run vertically downward in parallel with the wastewater conduit and the accumulator. The clean water pipes connect directly to an outgoing clean water supply line(s) connecting to a sink, faucet, water fountain, water pick, water-based tool, or other clean water supply fixture, such as, but not limited to, a sink 1020.

In this example, the sink 1020 is a traditional sink with one or more faucets, a basin, and a drain. However, the examples are not limited to a manifold supply water to a traditional sink. The clean water line(s) may supply clean water to a sink, water fountain, spout, water pick, water-based tool, water hydrant, or any other fixture for supplying water without demolition to reach underground water lines.

In this example, the set of panels provides structural support or stability to the manifold. Portion of the manifold may be attached to or anchored to portions of one or more of the panels. In this way, the manifold is made more stable and secure in a desirable position within a room or other space inside a structure. This further ensures the water lines connecting to the manifold remain securely attached to the connection members on the manifold.

Figure 11:
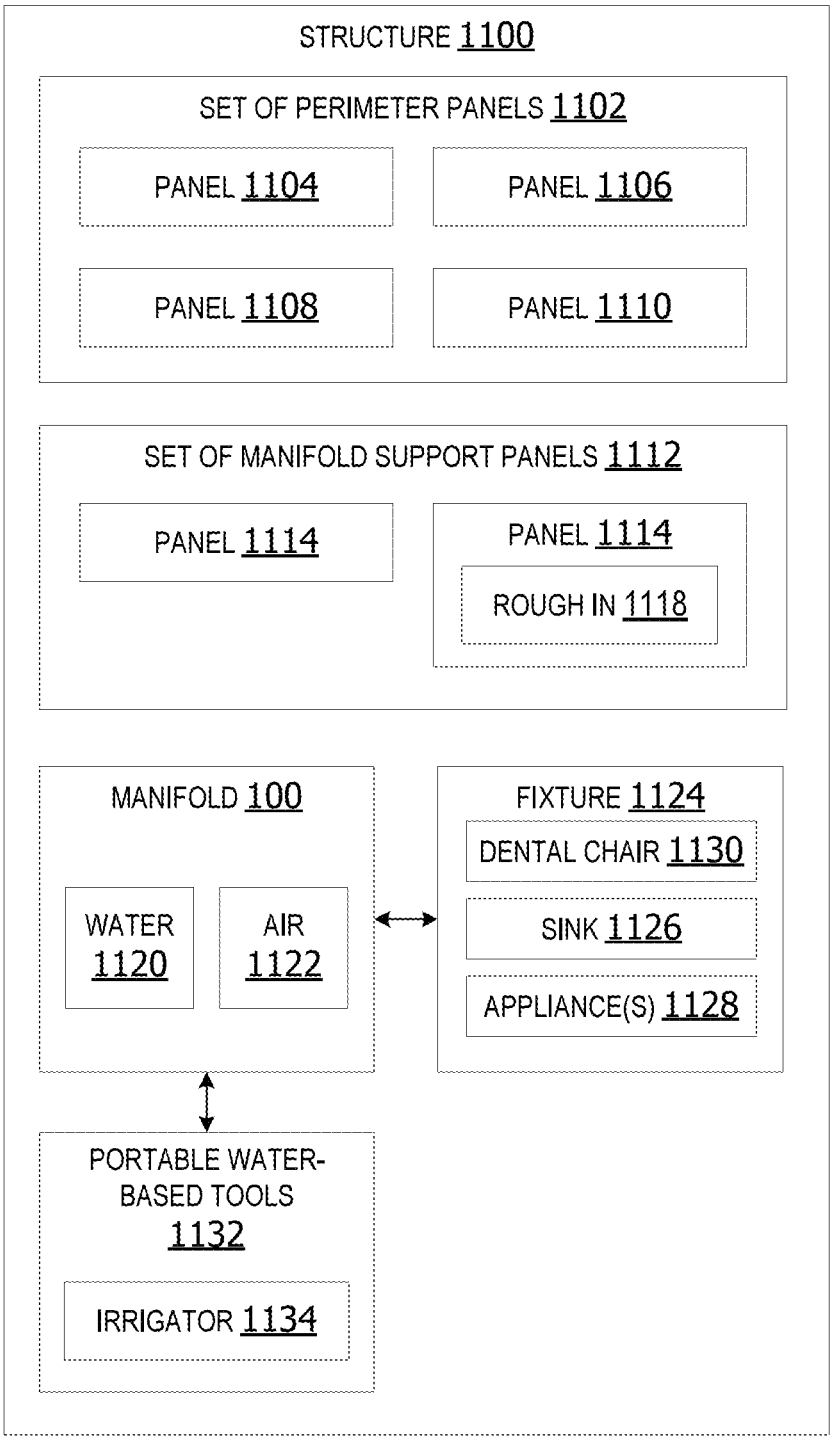
FIG. 11 is an exemplary block diagram illustrating a structure including a manifold and a set of support panels.

FIG. 11 is an exemplary block diagram illustrating a structure 1100 including a manifold 100 and a set of support panels 1112. The set of perimeter panels 1102 is a set of one or more panels forming a perimeter of a room or other space within the structure 1100. In other words, the set of perimeter panels 1102 creates a room or private space within a larger open space. In this example, the set of perimeter panels 1102 includes panel 1104, panel 1106, panel 1108 and panel 1106. However, the examples are not limited to four perimeter panels. In other examples, the set of perimeter panels is a null set, a set of one panel, two panels, three panels, as well as five or more perimeter panels.

The set of manifold support panels 1112 is a set of one or more panels abutting the manifold which can provide support to the manifold 100. In this example, the set of manifold support panels 1112 includes panel 1114 and a panel 1116 which includes a rough in 1118 to accommodate the horizontal water lines, including the supply line and the drainage line.

The manifold 100 provides water 1120 and/or air 1122 to one or more destinations, such as, but not limited to, a fixture 1124 and/or portable water-based tools 1132. The fixture 1124 can include a sink 1126, appliance(s) 1128 and/or dental chair 1130. An appliance may include a washing machine, dishwasher, sterilizer, or any other water utilizing device.

A portable water-based tool is a tool or device utilizing water. Portable water-based tools 1132 may include medical or dental devices, such as, but without limitation, an irrigator 1134. An irrigator may also be referred to as a water pick.

Figure 12:
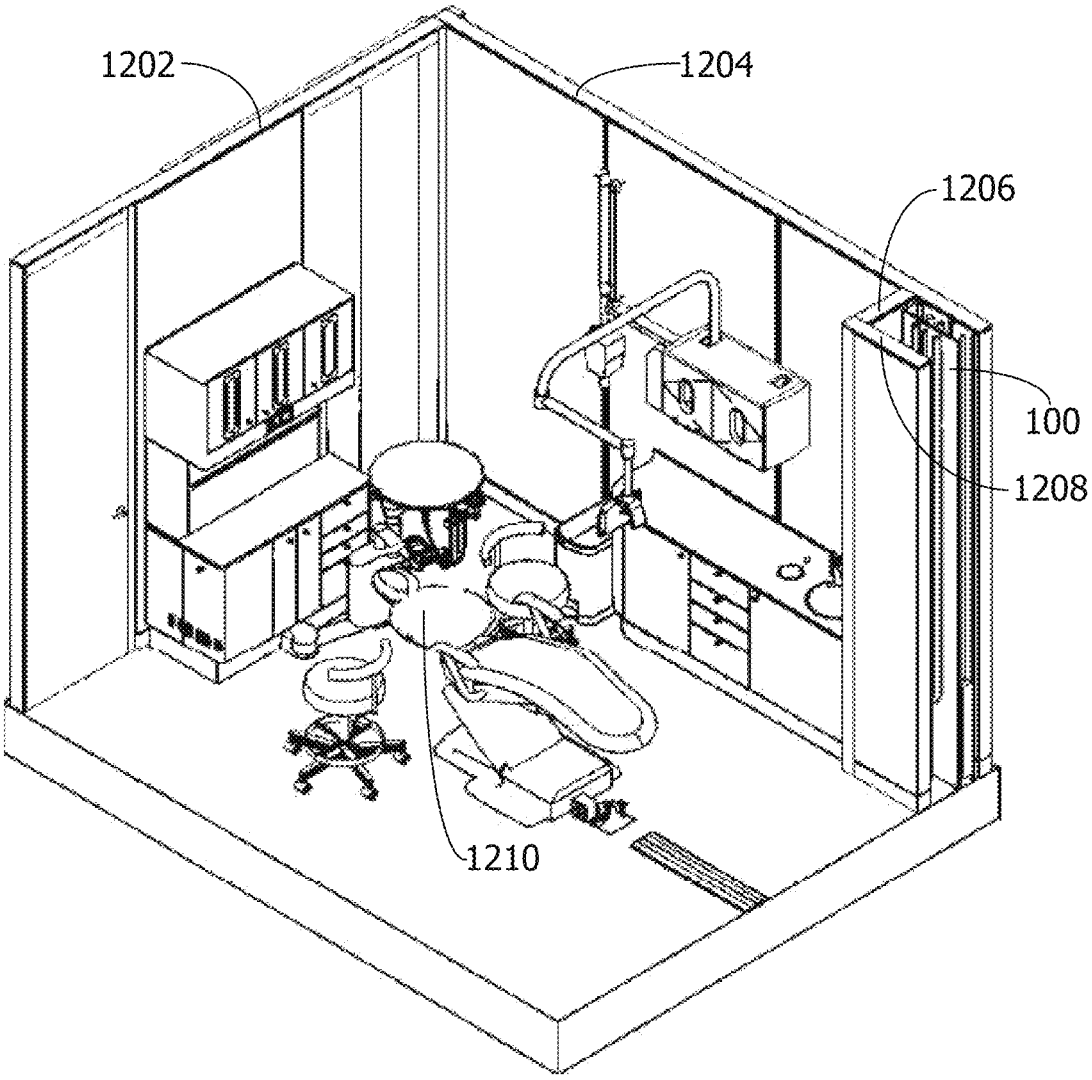
FIG. 12 is an exemplary block diagram illustrating a manifold and a set of panels within a structure.

FIG. 12 is an exemplary block diagram illustrating a manifold 100 and a set of panels within a structure. In this example, the set of panels includes a panel 1202 and a panel 1204 forming a perimeter of a room or other space. A panel 1206 and a panel 1208 partially enclose the manifold 100 and provide additional support to the manifold 100.

Figure 13:
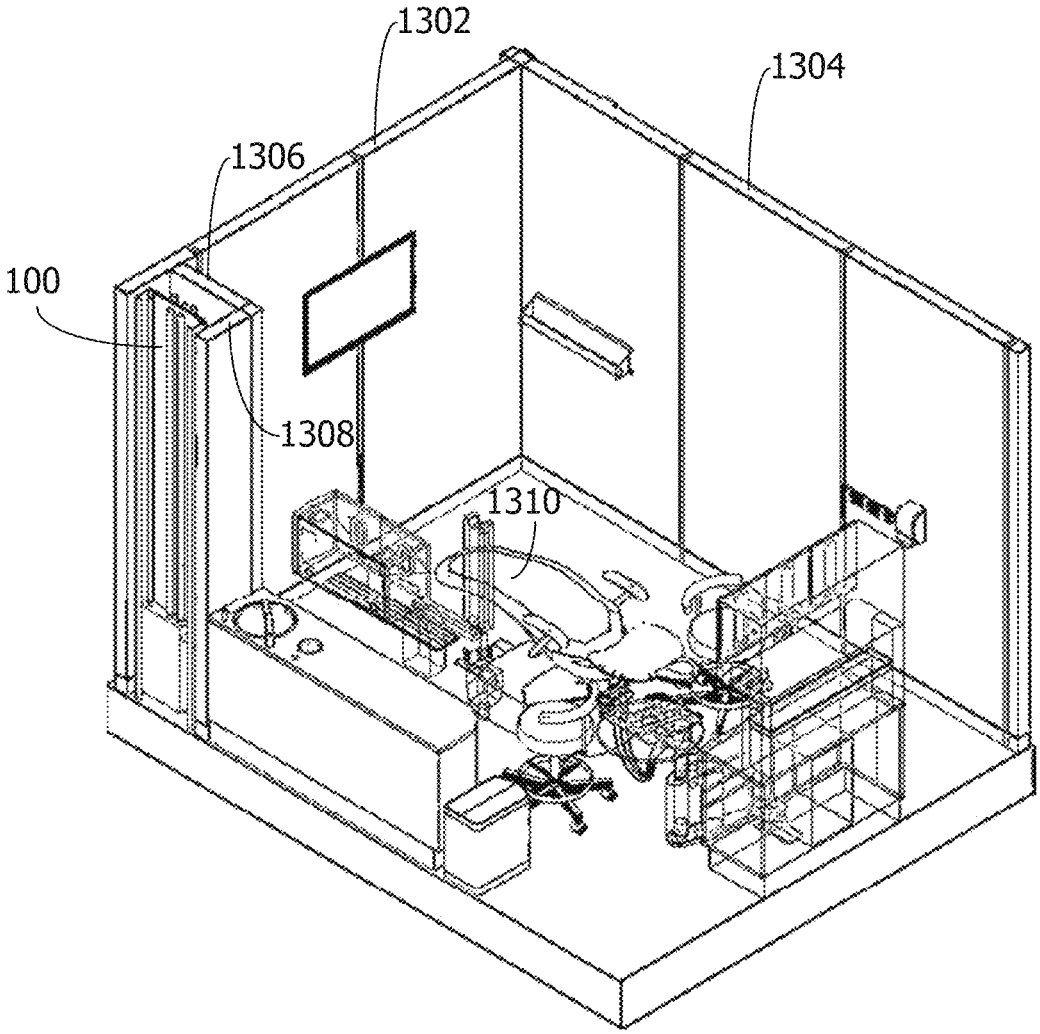
FIG. 13 is an exemplary block diagram illustrating a manifold connected to a sink within a structure.

FIG. 13 is an exemplary block diagram illustrating a manifold 100 connected to a sink within a structure. The manifold 100 is placed within a corner of the room formed by the set of perimeter panels. The perimeter panels include panel 1302 and panel 1304. The manifold is surrounded, in this non-limiting example, by the panel 1306 and 1308.

The manifold provides water to the sink abutting the panel 1308. In other examples, the manifold also provides water to one or more tools, appliances, and other fixtures. For example, the manifold may provide water to an irrigator used in conjunction with the dental chair 1310. Electrical wires providing electricity may also be dropped down from the ceiling structure to the manifold and from the manifold to a dental chair 1310. In this manner, electricity may be provided to the dental chair and other appliances or fixtures within the room without running wires through walls or floors.

Figure 14:
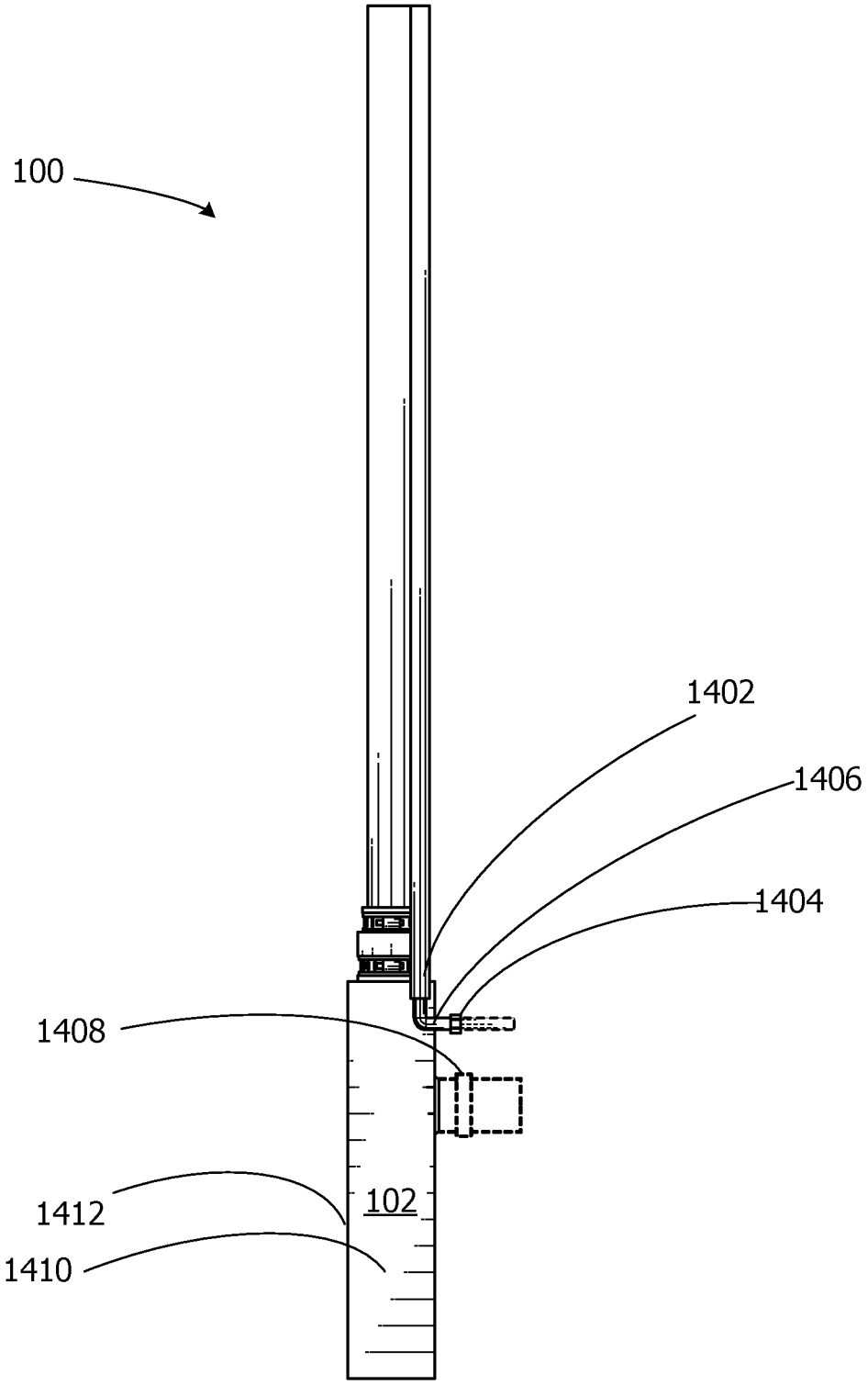
FIG. 14 is an exemplary block diagram illustrating a side view of a manifold.

FIG. 14 is an exemplary block diagram illustrating a side view of a manifold 100. The manifold 100 in this example includes a wastewater pipe 1402 through which wastewater exits the accumulator 102. The clean water lines, such as water line 1404, brings clean water to one or more fixture(s). The clean water line 1402 can bring hot water or cold water to the fixture(s). The clean water line 1402 connects to an incoming water line associated with the fixture(s) via a connector, such as, but not limited to, the connector 1404.

In this non-limiting example, the clean water line 1402 bends horizontally, such that the water line is running parallel to the floor proximate to the end including the connector 1404. In other words, the water line 1402 is a vertical water line having a horizontal member 1406 including the connector 1404 proximate to the accumulator.

A wastewater line from the fixture connects to the accumulator via a connector 1406. The connector creates a water-tight connection with the accumulator. Wastewater flows into the accumulator tank via the wastewater pipe (not shown) connected to a drain or other wastewater source. The connector 1406 in this example is shown attached to a front member of the accumulator. However, in other examples, the connector for incoming wastewater pipe connection can be located on the top member of the accumulator, a side member 1410 of the accumulator, a back member 1412 of the accumulator, or any other portion of the accumulator.

Figure 15:
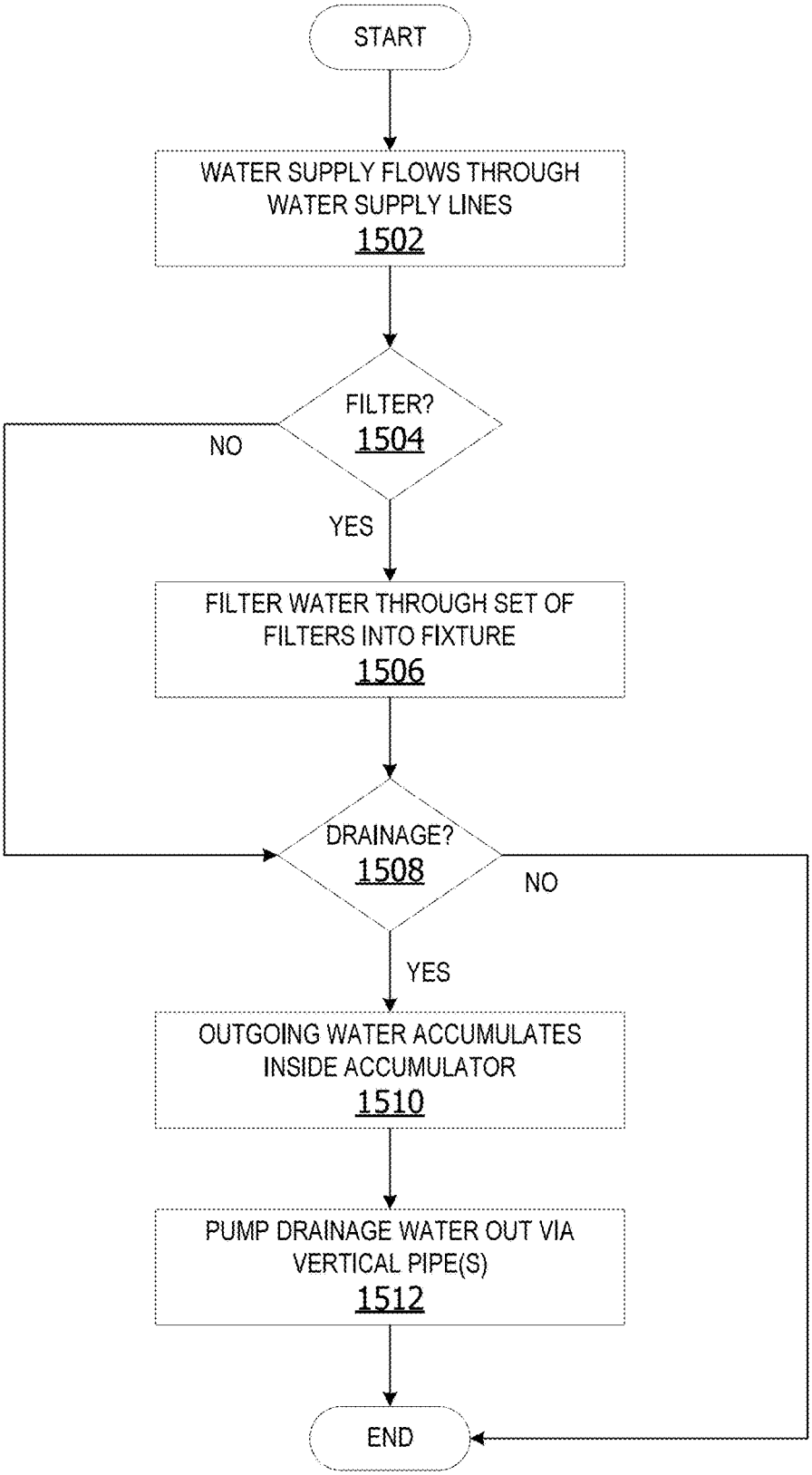
FIG. 15 is an exemplary flow chart illustrating operation of the manifold for supplying water to a fixture or other water-based tool.

FIG. 15 is an exemplary flow chart illustrating operation of the manifold for supplying water to a fixture or other water-based tool. The process begins by permitting water to flow through water supply lines at 1502. A determination is made whether to filter the water at 1504. If yes, the water is filtered through a set of filters associated with a water filtration system before the water is allowed to flow into a fixture or other source. A determination is made whether water is received from drainage lines at 1508. If yes, outgoing (drainage) water accumulates inside the accumulator at 1510. Drainage water is pumped out of the accumulator via vertical pipes running up toward ceiling panels at 1512. The process terminates thereafter.

Figure 16:
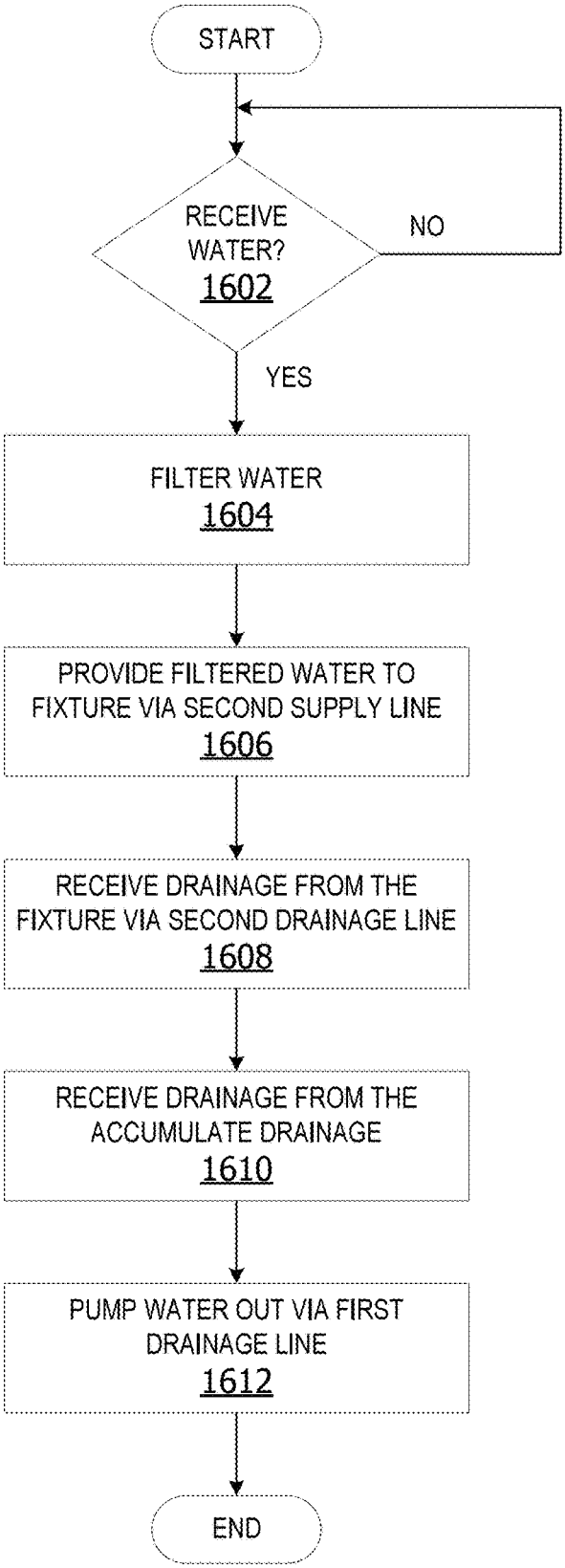
FIG. 16 is an exemplary flow chart illustrating operation of the manifold for supplying filtered water to a fixture or other water-based device Corresponding reference characters indicate corresponding parts throughout the drawings.

FIG. 16 is an exemplary flow chart illustrating operation of the manifold for supplying filtered water to a fixture or other water-based device. The process begins by determining if water is received from a first supply line at 1602. The first supply line may be connected to an underground water supply line, a water truck, a water hydrant, a water tank, a recreational vehicle water supply hookup connector or any other source of water. If water is received, the water is filtered by a set of filters associated with a water filtration system associated with the manifold at 1604. The filtered water is provided to a fixture or other device via a second supply line at 1606. Drainage is received from the fixture or other device via a second drainage line at 1608. The drainage accumulates in an accumulator at 1610. The water in the accumulator is pumped out by a set of pumps at 1612. The water leaves the accumulator via a first drainage line associated with the vertical conduit(s), such as, but not limited to, the set of vertical conduits 108 in FIG. 1. The process terminates thereafter.

Additional Examples

In some examples, the manifold is utilized with interchangeable wall panels to insulate and support the manifold in conjunction with ceiling tiles to achieve acoustic rating. The manifold sits above ground, on the floor of an existing structure or on the ground at a temporary campground, parking lot or any other area to provide water to devices while avoiding demolition otherwise necessary for underground access to water lines. The wall panels also provide camouflage, hiding the manifold from view for improved aesthetics. The manifold system provides water and removes sewage/drainage water without being confined by constraints of proximity to sewer, water, gas, electricity, or other utility lines. This provides the easiest and least expensive option to expand/modify plumbing setup for fixtures, such as sinks and dental chairs in the least disruptive manner.

In other examples, the manifold is an above slab/foundation system that may be set up anywhere, modularly. The device can provide water, gas, compressed air, vacuum suction, electricity lines, network lines, phone lines or other utility lines via conduits running from the ceiling to the manifold without removal of walls and without running lines or conduits through walls. This enable quick setup and easy access to the manifold for maintenance and/or repair.

The manifold can distribute needed resources/utilities to every place in the room. The manifold makes it easier to access and reconfigure manifold, support panels and fixtures without losing integrity of room itself (where wall panels are located). Also, once wall panels are interlocked, the panels provide additional structural integrity in some examples.

The manifold provides a fast-deployable solution for any building, whether temporary or permanent. The panels are interchangeable and interlockable enable easy modification and reconfiguration of room layouts in any building, even multi-level structures without having to run permanent plumbing pipes within walls, floors or under the foundation.

In one example, the manifold device sits on the floor with water pipes running vertically downward from the ceiling into the accumulator. The pipes run perpendicular out the side of the accumulator into the sink or other fixture. Support brackets/frame/wall panels stabilize the device. The pipes include both incoming water lines and drainage (outgoing sewer) lines. The accumulator can include wiring or a wiring harness (bundle of wires) which runs down to the accumulator for electrical, network/internet, cable, etc. A splitter is associated with the accumulator in some examples to enable wiring for various devices to branch off to devices within the room.

In still other examples, water/sewer pipes running vertically to above ceiling connections while perpendicular pipes connect into fixtures or through modular rough-ins. Support brackets stabilize the device. The filtering system purifies water where the local water supply may be contaminated or untrustworthy.

In an example scenario, the manifold may be used in a temporary medical or dental office setup to supply water and compressed air to sinks, dental tools, dental chairs, etc. The manifold may also be used in retrofitting existing spaces with panels to accommodate new room layouts without altering existing plumbing and other utility lines. Other scenarios for manifold utilization include, for example but without limitation, disaster relief, temporary office space, reconfigurable office space, mobile home parks, temporary housing, temporary hospitals or other medical treatment areas, reconfigurable residential living, recreational vehicle encampments, etc. without the necessity of subsurface utility work.

Alternatively, or in addition to the other examples described herein, examples include any combination of the following:

- the accumulator is a first accumulator accumulates drainage from a first fixture;
- a second accumulator, the second accumulator accumulating drainage from a second fixture;
- the first supply line further comprises a hot water line and a cold-water line;
- a vacuum pump providing vacuum to at least one tool;
- a set of panels at least partially enclosing the manifold, wherein the set of panels provides support to at least a portion of the manifold;
- a set of filters that filters water entering the manifold via the first supply line;
- a set of water shut off valves;
- a tankless water heater that heats water entering the tankless water heater via the first supply line;
- receiving water via a first supply line associated with a set of vertical conduits connecting to a top member of an accumulator associated with configurable manifold, the set of vertical conduits comprising the first supply line and a first drainage line;
- filtering the water via a set of filters;
- providing the filtered water to at least one fixture via a second supply line associated with a set of horizontal conduits connecting to a side member of the accumulator, the set of horizontal conduits comprising the second supply line and a second drainage line;
- receiving drainage from the fixture via the second drainage line;
- accumulating the drainage within an interior of the accumulator;
- pumping, by a set of pumps, the accumulated water out of the manifold via the first drainage line;
- accumulating drainage water from a second fixture in a second accumulator;
- supplying hot water from the manifold to a fixture via a hot water supply line;
- supplying cold water from the manifold to the fixture via a cold-water supply line;
- providing vacuum for a suction tool via a vacuum pump associated with the manifold;
- heating water entering the manifold via a tankless water heater associated with the manifold;
- shutting off flow of water through the second supply line responsive to activation of a shut off valve;
- a first supply line providing water into the manifold, the first supply line connecting to the manifold;
- a set of filters removes impurities from the water;
- a second supply line provides the filtered water to a fixture, the second supply line connecting to the manifold;
- a first drainage line receiving drainage water from the fixture;
- an accumulator stores accumulated drainage water received from the first drainage line;
- a pump moves drainage water out of the accumulator via a second drainage line, the second drainage line associated with a set of vertical conduits running vertically upwards toward a ceiling structure;

a set of support members connecting at least a portion of the set of vertical conduits to a portion of a support frame;

a set of panels at least partially enclosing the manifold, wherein the set of panels provides support to at least a portion of the manifold;

a wiring bundle, the wiring bundle comprising at least one of electrical wires, network cable or telephone wires;

a second accumulator, the second accumulator accumulating drainage from a second fixture; and a tankless water heater that heats water entering the tankless water heater via the first supply line.

The order of execution or performance of the operations in examples of the disclosure illustrated and described herein is not essential, unless otherwise specified. That is, the operations can be performed in any order, unless otherwise specified, and examples of the disclosure can include additional or fewer operations than those disclosed herein. For example, it is contemplated that executing or performing an operation before, contemporaneously with, or after another operation is within the scope of aspects of the disclosure.

When introducing elements of aspects of the disclosure or the examples thereof, the articles "a," "an," "the," and "said" are intended to mean that there are one or more of the elements. The terms "comprising," "including," and "having" are intended to be inclusive and mean that there can be additional elements other than the listed elements. The term "exemplary" is intended to mean "an example of" The phrase "one or more of the following: A, B, and C" means "at least one of A and/or at least one of B and/or at least one of C."

The indefinite articles "a" and "an," as used in the specification and in the claims, unless clearly indicated to the contrary, should be understood to mean "at least one." The phrase "and/or," as used in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of or "exactly one of," or, when used in the claims, "consisting of," will refer to the inclusion of exactly one element of a number or list of elements. In general, the term "or" as used shall only be interpreted as indicating exclusive alternatives (i.e. "one or the other but not both") when preceded by terms of exclusivity, such as "either," "one of" "only one of" or "exactly one of." "Consisting essentially of," when used in the claims, shall have its ordinary meaning as used in the field of patent law.

As used in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

The use of "including," "comprising," "having," "containing," "involving," and variations thereof, is meant to encompass the items listed thereafter and additional items.

Use of ordinal terms such as "first," "second," "third," etc., in the claims to modify a claim element does not by itself connote any priority, precedence, or order of one claim element over another or the temporal order in which acts of a method are performed. Ordinal terms are used merely as labels to distinguish one claim element having a certain name from another element having a same name (but for use of the ordinal term), to distinguish the claim elements.

Having described aspects of the disclosure in detail, it will be apparent that modifications and variations are possible without departing from the scope of aspects of the disclosure as defined in the appended claims. As various changes could be made in the above constructions, products, and methods without departing from the scope of aspects of the disclosure, it is intended that all matter contained in the above description and shown in the accompanying drawings shall be interpreted as illustrative and not in a limiting sense.

What is claimed is:

1. A system for water management, the system comprising:

a support frame;

a first accumulator that stores water received from a first supply line;

a first vertical conduit vertically disposed within the support frame and connecting to a top member of the first accumulator, the first vertical conduit providing the first supply line;

a first horizontal conduit connecting to a side member of the first accumulator, the first horizontal conduit comprising a second supply line from the first accumulator to a fixture;

a second accumulator that receives drainage water from the fixture;

a second vertical conduit vertically disposed within the support frame and associated with a first drainage line;

a second horizontal conduit connecting to a side member of the second accumulator, the second horizontal conduit including a second drainage line that directs the drainage water away from the second accumulator to the first drainage line;

a set of support members connecting at least a portion of the first and second vertical conduits to a portion of the support frame; and a pump associated with the second accumulator, wherein the pump assists with moving the drainage water out of the second accumulator through the second drainage line to the first drainage line associated with the second vertical conduit.

2. The system of claim 1, wherein the first vertical conduit further comprises:

a hot water supply line; and a cold water supply line.

3. The system of claim 1, further comprising:

a second pump providing suction to at least one tool.

4. The system of claim 1, further comprising:

a set of wires vertically disposed along at least one of the support frame or at least one vertical conduit, the set of wires associated with at least one device.

5. The system of claim 1, further comprising:

a set of filters associated with the first accumulator that filters the water received from the first supply line as it enters the first accumulator.

6. The system of claim 1, further comprising:

a first shut off valve to terminate water flow from the first supply line into the first accumulator; and a second shut off valve to terminate drainage flow from the second accumulator to the second vertical conduit.

7. The system of claim 1, further comprising:

a tankless water heater associated with the first accumulator that heats the water entering the first accumulator via the first supply line.

8. A method for water management, the method comprising:

receiving water at an accumulator via a first supply line associated with a set of vertical conduits vertically disposed within a support frame, the set of vertical conduits connecting to a top member of the accumulator, the set of vertical conduits a first vertical conduit providing the first supply line;

filtering the water via a set of filters associated with the accumulator;

storing the filtered water within the accumulator;

providing the filtered water to at least one fixture via a second supply line associated with a set of horizontal conduits connecting to a side member of the accumulator, the set of horizontal conduits a first horizontal conduit providing the second supply line and a second horizontal conduit providing a first drainage line;

receiving, at the accumulator, drainage water from the fixture via a second drainage line disposed between the fixture and the accumulator; and evacuating the drainage water from the accumulator, via the first drainage line.

9. The method of claim 8, further comprising:

accumulating other drainage water from a second fixture in a second accumulator.

10. The method of claim 8, further comprising:

heating the water received at the accumulator via a tankless water heater.

11. The method of claim 8, wherein the evacuating of the drainage water from the accumulator includes using a vacuum pump.

12. A manifold for distributing water, the manifold comprising:

a support frame;

a first accumulator;

a first supply line providing water to the first accumulator, the first supply line associated with a first vertical conduit vertically disposed within the support frame;

a filter that removes impurities from the water provided by the first supply line to the first accumulator;

a second supply line providing filtered water from the accumulator to a fixture;

a first drainage line receiving drainage water from the fixture;

a second accumulator that stores the drainage water received from the first drainage line; and a pump that facilitates evacuation of the drainage water from the second accumulator via a second drainage line, the second drainage line associated with a second vertical conduit vertically disposed within the support frame.

13. The manifold of claim 12, further comprising:

a set of support members connecting at least a portion of at least one of the first accumulator, the second accumulator, the first vertical conduit, and the second vertical conduit to a portion of the support frame.

14. The manifold of claim 12, further comprising:

a set of panels at least partially enclosing the manifold, wherein the set of panels provides support to at least a portion of at least one of the first accumulator, the second accumulator, the first vertical conduit, and the second vertical conduit.

15. The manifold of claim 12, further comprising:

a wiring bundle, the wiring bundle comprising at least one of electrical wires, network cable or telephone wires.

* * * * *